US010529258B1

(12) United States Patent
Brown et al.

(10) Patent No.: US 10,529,258 B1
(45) Date of Patent: Jan. 7, 2020

(54) BADGE-HOLDING DEVICE

(71) Applicants: Annette Brown, Randallstown, MD (US); Kevin Brown, Sr., Randallstown, MD (US)

(72) Inventors: Annette Brown, Randallstown, MD (US); Kevin Brown, Sr., Randallstown, MD (US)

( * ) Notice: Subject to any disclaimer, the term of this patent is extended or adjusted under 35 U.S.C. 154(b) by 0 days.

(21) Appl. No.: 16/005,840

(22) Filed: Jun. 12, 2018

(51) Int. Cl.
*G09F 3/20* (2006.01)
*A45C 1/06* (2006.01)
*A45C 11/18* (2006.01)
*A45F 5/02* (2006.01)

(52) U.S. Cl.
CPC ..... *G09F 3/207* (2013.01); *A45C 1/06* (2013.01); *A45C 11/182* (2013.01); *A45F 5/021* (2013.01); *A45F 5/022* (2013.01); *A45C 2001/062* (2013.01); *A45C 2001/065* (2013.01); *A45F 2200/055* (2013.01)

(58) Field of Classification Search
CPC ..... A45C 2001/065; A45F 2005/002; G09F 3/207
USPC ..... 40/1.5, 586, 661.04; 224/600
See application file for complete search history.

(56) References Cited

U.S. PATENT DOCUMENTS 3,660,915 A 5/1972 Davis
3,931,688 A * 1/1976 Owens ..... A44C 3/001 40/1.5
4,316,492 A * 2/1982 Plough ..... A45C 1/06 150/143
5,791,076 A * 8/1998 Gailliard ..... A44C 3/001 40/1.5
6,840,420 B1 1/2005 Hudson
8,726,952 B2 5/2014 Jambunathan
D723,800 S 3/2015 Ziegler
9,427,068 B2 8/2016 Seuk
2004/0221499 A1* 11/2004 Hansen ..... A45C 1/06 40/654.01
2011/0265355 A1* 11/2011 Babbitt ..... A44C 3/002 40/1.5
2013/0256348 A1* 10/2013 Seuk ..... A45F 5/021 224/267
2014/0083578 A1 3/2014 Moore

FOREIGN PATENT DOCUMENTS

WO 2006044668 A 7/2006

* cited by examiner

*Primary Examiner* — Joanne Silbermann

(57) ABSTRACT

The badge-holding device is a wallet for displaying a police, fire, or EMT badge. The badge display device comprises a badge retainer and channel for the pin of the badge on one side and a plurality of card pockets on the other side. The pockets may be used to store identification cards, credit cards, debit cards, and similar cards. A black band may be stretched across the front of the displayed badge and fastened in place when mourning band protocol is in effect. A clip on the pocket side of the badge-holding device allows the device to be worn on a belt or pocket or allows the device to act as a money clip. Loops located at the top of the device allow the device to be worn on a chain around the user's neck.

15 Claims, 5 Drawing Sheets

BADGE-HOLDING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of badge wallets, more specifically, a badge-holding device.

SUMMARY OF INVENTION

The badge-holding device is a wallet for displaying a police, fire, or EMT badge. The badge display device comprises a badge retainer and channel for the pin of the badge on one side and a plurality of card pockets on the other side. The pockets may be used to store identification cards, credit cards, debit cards, and similar cards. A black band may be stretched across the front of the displayed badge and fastened in place when mourning band protocol is in effect. A clip on the pocket side of the badge-holding device allows the device to be worn on a belt or pocket or allows the device to act as a money clip. Loops located at the top of the device allow the device to be worn on a chain around the user's neck.

An object of the invention is to provide a wallet that can be used to display a metal badge.

Another object of the invention is to provide a plurality of card pockets.

A further object of the invention is to provide a belt clip and loose for a chain to be used for displaying the metal badge.

Yet another object of the invention is to provide a black band to cover the metal badge during mourning periods.

These together with additional objects, features and advantages of the badge-holding device will be readily apparent to those of ordinary skill in the art upon reading the following detailed description of the presently preferred, but nonetheless illustrative, embodiments when taken in conjunction with the accompanying drawings.

In this respect, before explaining the current embodiments of the badge-holding device in detail, it is to be understood that the badge-holding device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the badge-holding device.

It is therefore important that the claims be regarded as including such equivalent construction insofar as they do not depart from the spirit and scope of the badge-holding device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
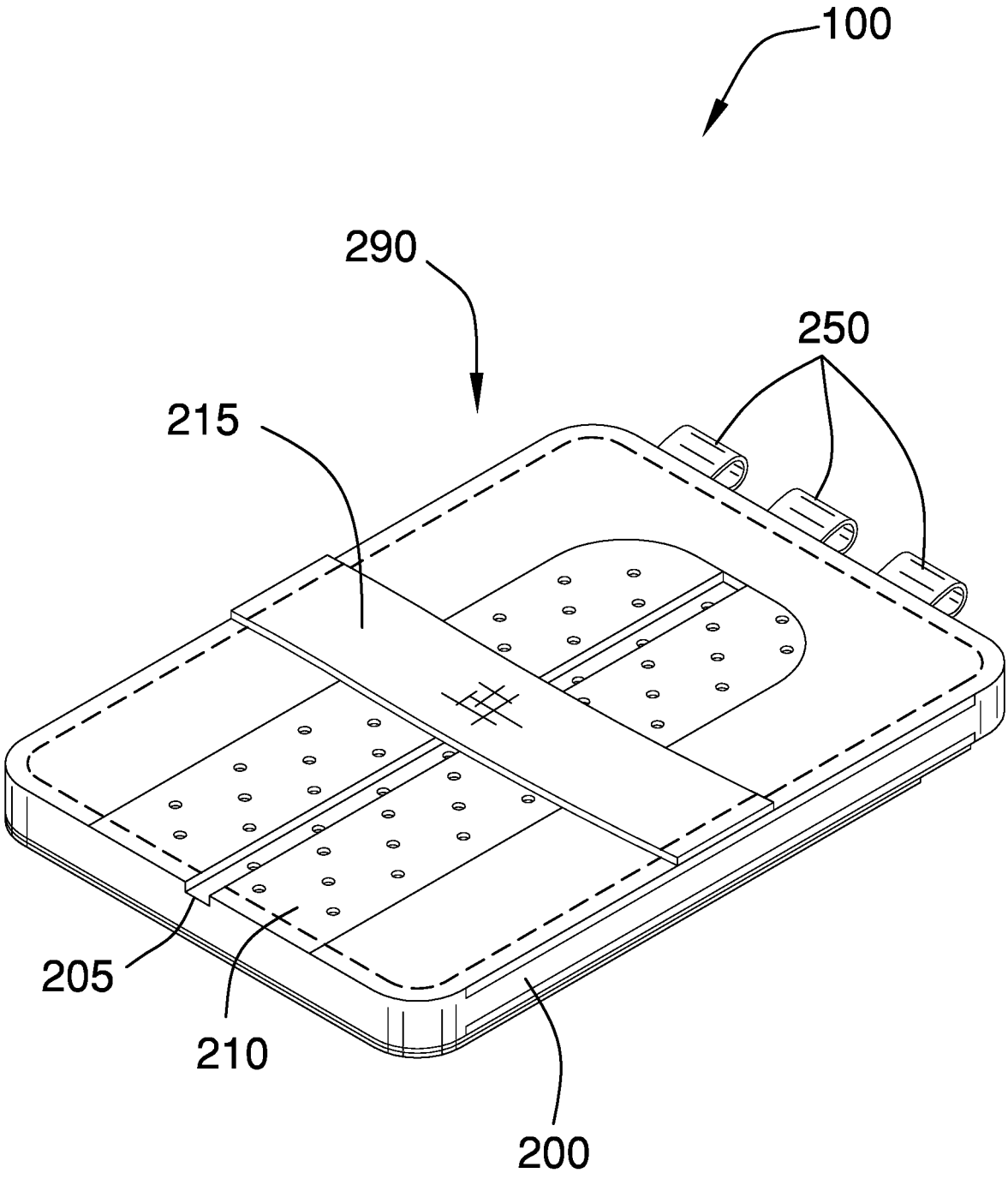
FIG. 1 is a perspective view of an embodiment of the disclosure.
Figure 2:
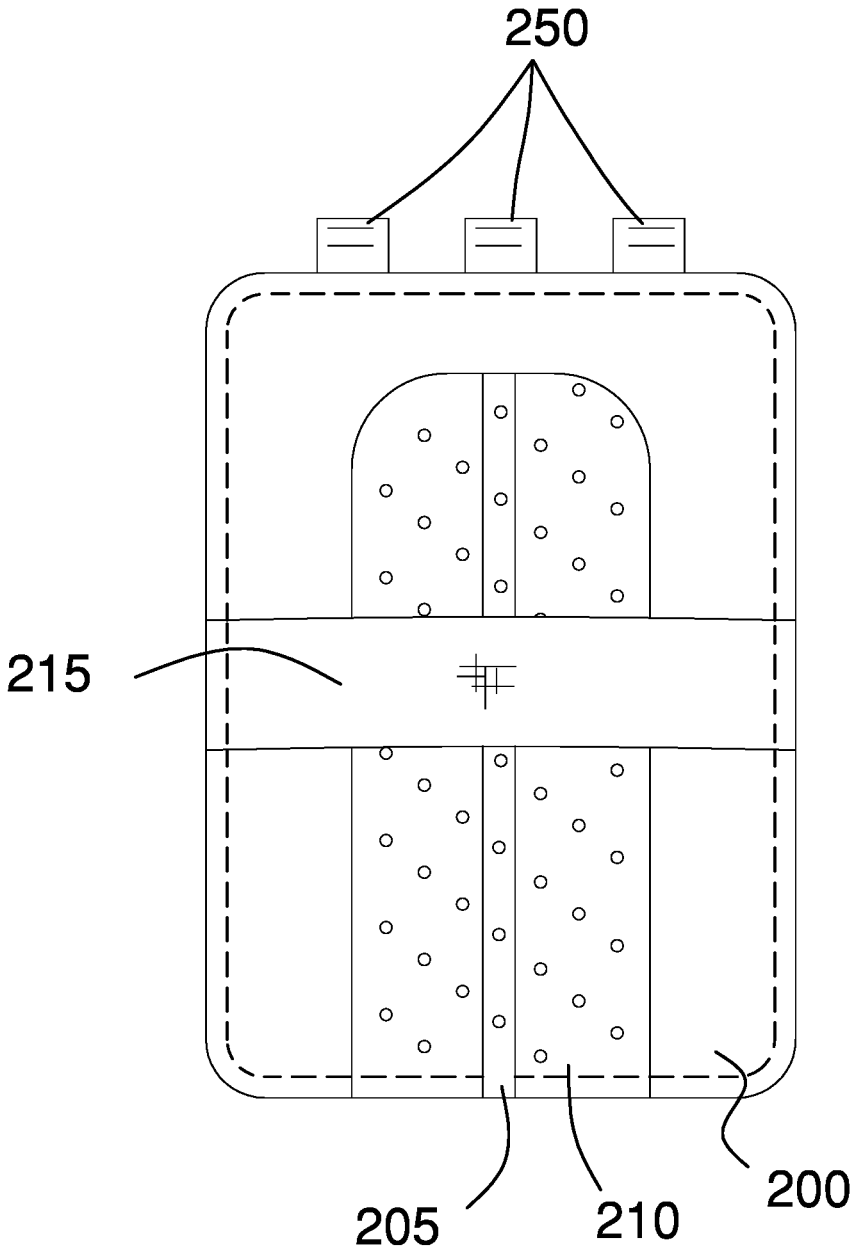
FIG. 2 is a front view of an embodiment of the disclosure.
Figure 3:
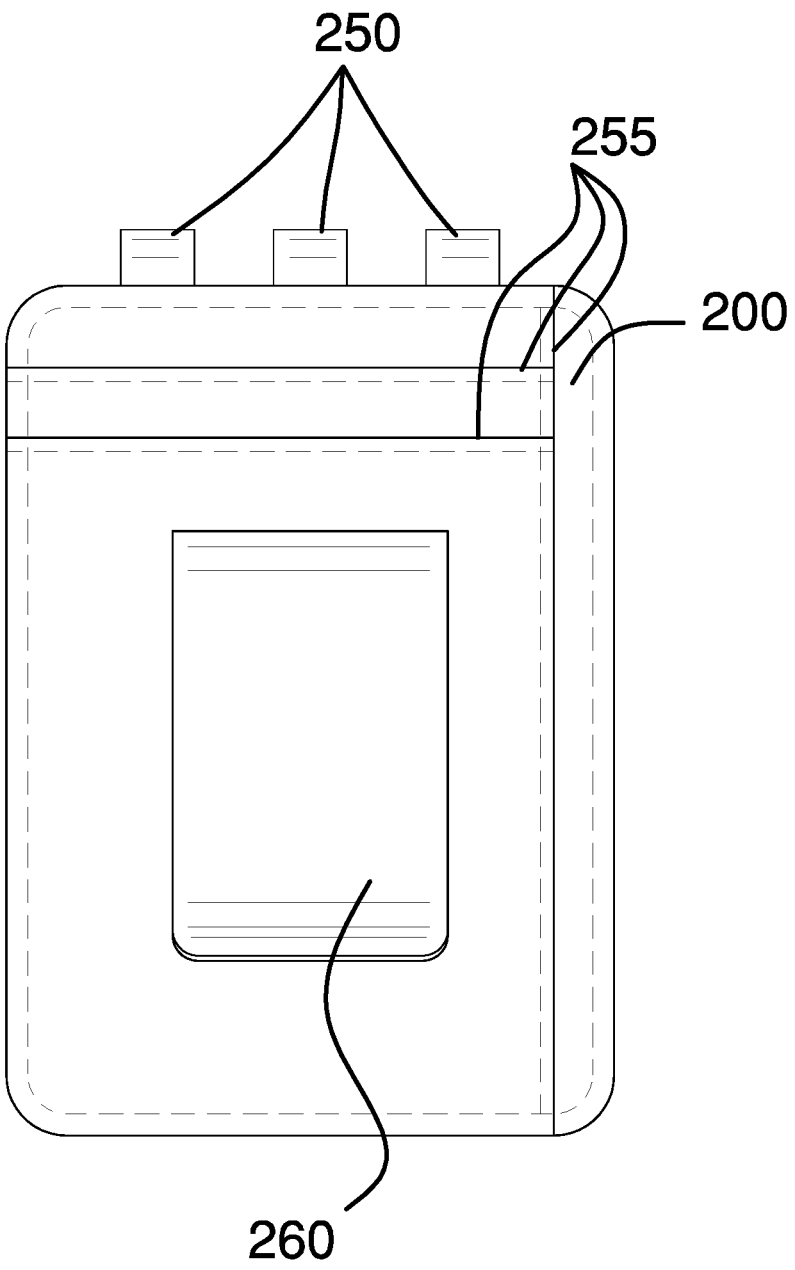
FIG. 3 is a rear view of an embodiment of the disclosure.
Figure 4:
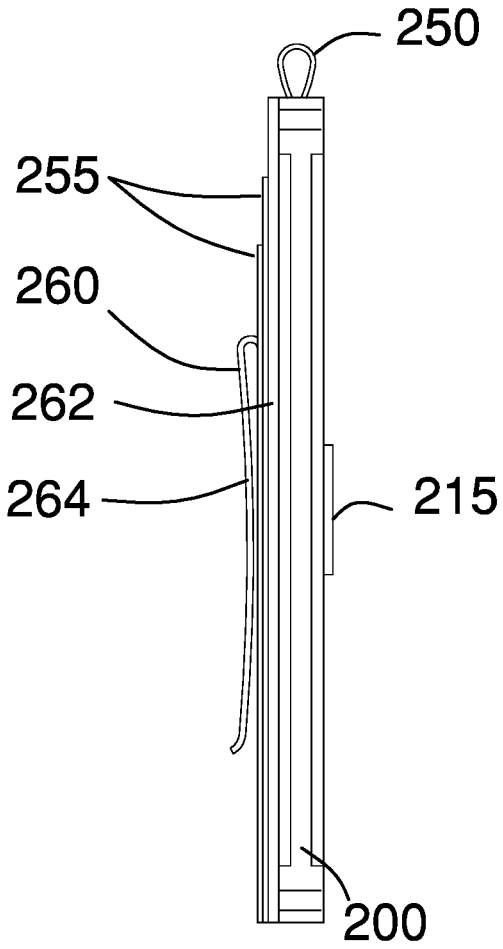
FIG. 4 is a side view of an embodiment of the disclosure.
Figure 5:
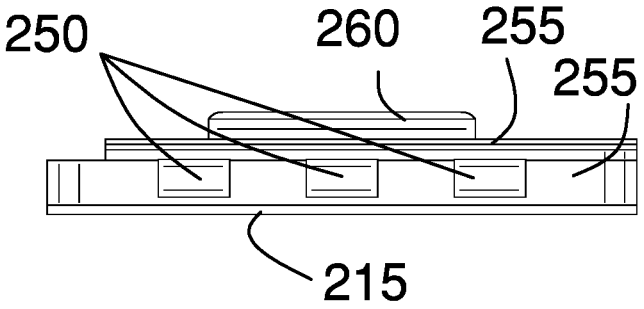
FIG. 5 is a top view of an embodiment of the disclosure.
Figure 6:
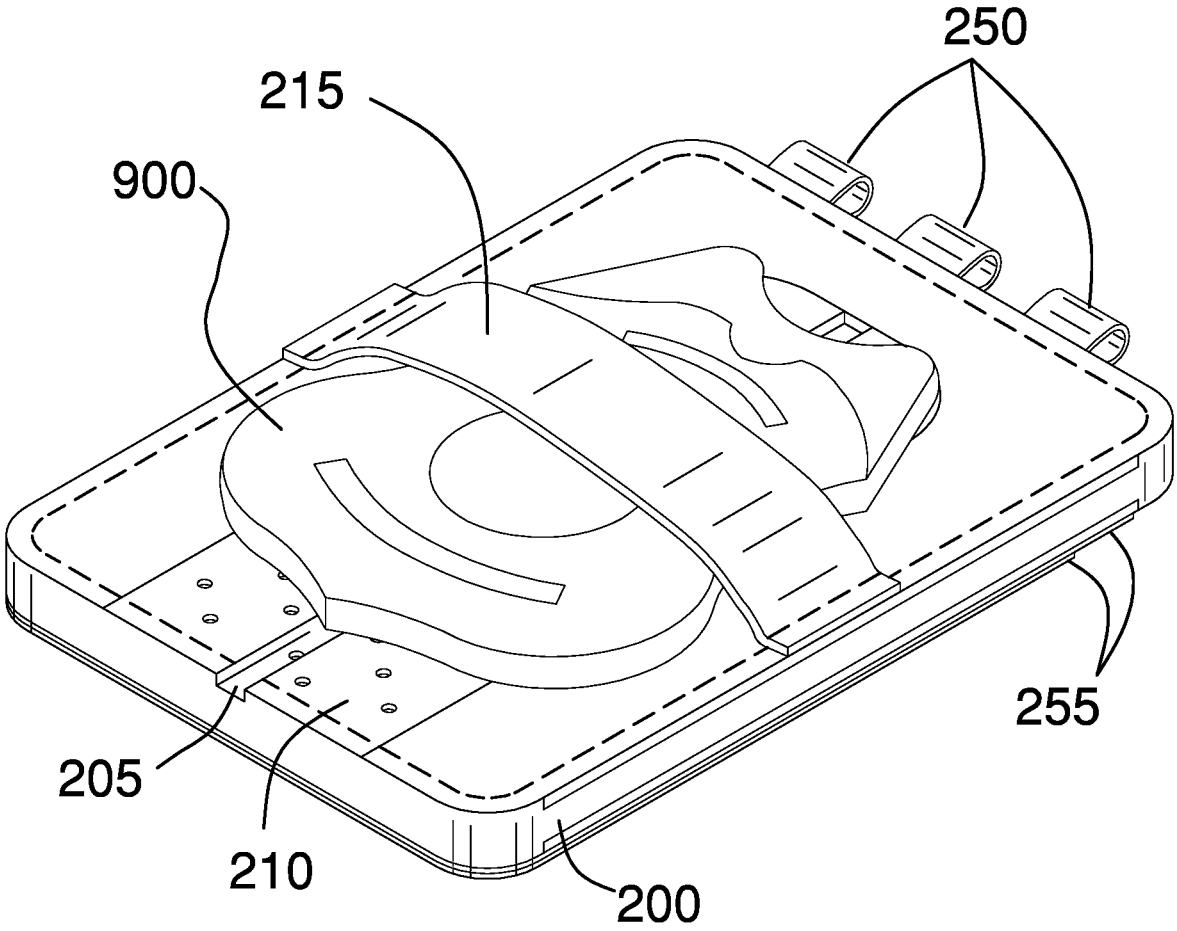
FIG. 6 is an in-use view of an embodiment of the disclosure.

Detailed reference will now be made to a first potential embodiment of the disclosure, which is illustrated in FIGS. 1 through 6.

The badge-holding device 100 (hereinafter invention) comprises a backing 200, a recessed channel 205, a badge retainer 210, a black band 215, one or more chain loops 250, a plurality of card pockets 255, and a clip 260.

The backing 200 may be a rigid base onto which the badge retainer 210, the black band 215, the plurality of card pockets 255, and the clip 260 may be coupled. The backing 200 may be fabricated from a single material or it may be fabricated from a rigid core material enclosed by a covering. As non-limiting examples, the core may be laminated cardstock, fiberboard, plastic, metal, resin, or combinations thereof. As non-limiting examples, the covering may be natural or synthetic leather, vinyl, neoprene, or felt.

In a preferred embodiment, the backing 200 may be a leather rectangle measuring 2.8 inches side and 4 inches high.

The recessed channel 205 may be a vertical depression on a front face 290 of the backing 200. The recessed channel 205 may provide space for a pin of a badge 900 to seat into so that the back of the badge 900 rests flush on the front face 290 of the backing 200.

The badge retainer 210 may be a surface that the badge 900 may be pinned onto. The badge retainer 210 may be a mesh or perforated material, which may accommodate inconsistent sizes for the badges 900. The badge retainer 210 may cover at least the recessed channel 205 of the front face 290 and may cover a larger portion of the front face 290, up to and including the entire surface of the front face 290.

The black band 215 may be a strap of black, elastic material. One end of the black band 215 may couple to the side of the backing 200 at a midpoint of the side such that the black band 215 may be pulled across the front face 290 of the backing 200, crossing perpendicular to the recessed channel 205. The black band 215 may be pulled across the front of the badge 900 as an honor band during times when mourning band protocol is in effect. When the black band 215 is not being used, the black band 215 may be tucked into one of the plurality of card pockets 255 on the rear side of the backing 200.

The black band 215 may comprise a band fastener to hold the black band 215 in place while it is being displayed. The band fastener used for the black band 215 may simply be stitching, adhesive, or some other means of securement, which secures each end of the black band 215 to the invention 100. When the black band 215 is not being displayed, it may be tucked into one of the plurality of card pockets 255.

The invention 100 may be adapted to be worn around a neck of a user (not illustrated in the figures) by passing a chain (not illustrated in the figures) through the one or more chain loops 250. The one or more chain loops 250 may be coupled to the top of the backing 200. If the one or more chain loops 250 comprise more than one loop, the one or more chain loops 250 are oriented so that the openings of each of the one or more chain loops 250 align with each other.

The plurality of card pockets 255 may be used to hold one or more cards. Non-limiting examples of the one or more cards include identification cards, credit cards, and debit cards. Each of the plurality of card pockets 255 may be a flexible or semi-rigid flap coupled to the backing 200 or to the plurality of card pockets 255 that underlie it. The flap may be coupled along three sides, leaving one side open for access to the space behind the flap. The plurality of card pockets 255 may be oriented with the open side at the top, on one side, or a combination thereof. In some embodiments, one of the plurality of card pockets 255 opens adjacent to the black band 215 so that the black band 215 may be stored within the plurality of card pockets 255. In the figures, the numbering of the plurality of card pockets 255 points to the open side of the plurality of card pockets 255.

The clip 260 may be a U-shaped metal spring. The clip 260 may be used to attach the invention 100 to a belt, a garment pocket, or other article of clothing. The clip 260 may alternatively be used as a money clip if the invention 100 is carried in the garment pocket. A first side 262 of the clip 260 may be coupled to the plurality of card pockets 255 on the rear side of the invention 100 such that the U is inverted, with the open end of the U on the bottom. A second side 264 of the clip 260 may be concave when viewed from the clip 260 side to more securely grasp the belt, currency, or other object to which the clip 260 is attached. The end of the clip 260 may be beveled to facilitate insertion of objects into the clip 260.

In use, the badge 900 is attached to the invention 100 by opening the pin of the badge 900, passing the pin through the badge retainer 210 such that the pin aligns with the recessed channel 205, and closing the pin. The one or more cards may be placed into the plurality of card pockets 255 for carrying and the one or more cards may be individually removed from the plurality of card pockets 255 when needed. To display the badge 900, the invention 100 may be clipped to the garment pocket or the belt using the clip 260. The badge 900 may also be displayed by passing the chain through the one or more chain loops 250 and wearing the invention 100 around the neck of the user. To conceal the badge 900, the invention 100 may be carried in the garment pocket. When the clip 260 is not used to display the badge 900, the clip 260 may be used to hold the currency.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, "align" refers to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, a "band" is a flat loop of material.

As used in this disclosure, a "clip" is a fastener that attaches to an object by gripping or clasping the object. A clip is typically spring loaded.

As used in this disclosure, "concave" is used to describe a surface that resembles the interior surface of a sphere or a portion thereof.

As used herein, the words "couple", "couples", "coupled" or "coupling", refer to connecting, either directly or indirectly, and does not necessarily imply a mechanical connection.

As used in this disclosure, "elastic" refers to a material or object that deforms when a force is applied to it and that is able to return to its relaxed shape after the force is removed. A material that exhibits these qualities is also referred to as an elastomeric material.

As used in this disclosure, a "fastener" is a device that is used to join or affix two objects. Fasteners generally comprise a first element, which is attached to the first object and a second element which is attached to the second object such that the first element and the second element join to affix the first object and the second object. Common fasteners include, but are not limited to, hooks, zippers, snaps, buttons, buckles, quick release buckles, or hook and loop fasteners.

As used in this disclosure, "felt" is a nonwoven sheet of matted material made from textile fibers.

As used in this disclosure, "flexible" refers to an object or material which will deform when a force is applied to it, which will not return to its original shape when the deforming force is removed, and which may not retain the deformed shape caused by the deforming force.

As used in this disclosure, the term "flush" is used to describe that a first surface is aligned with a second surface.

As used herein, "front" indicates the side of an object that is closest to a forward direction of travel under normal use of the object or the side or part of an object that normally presents itself to view or that is normally used first. "Rear" or "back' refers to the side that is opposite the front.

As used herein, the words "invert", "inverted", or "inversion" refer to an object that has been turned inside out or upside down or to the act of turning an object inside out or upside down.

As used here, the word "midpoint" refers to a point near the center of an object. An "exact midpoint" refers to a midpoint that is equidistant from edges of the object in at least one direction. Unless otherwise stated, a midpoint is not required to be at the exact center of the object but instead may be within 50% of the distance from the exact midpoint to the farthest edge.

As used in this disclosure, a "pocket" is a pouch or storage space that is formed into an object. Pockets are often formed by joining a second textile or a second sheeting to a first textile or a first sheeting, respectively, by sewing or heat sealing respectively.

As used in this disclosure, "resilient" or "semi-rigid" refer to an object or material which will deform when a force is applied to it and which will return to its original shape when the deforming force is removed.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure a "strap" is a strip of leather, cloth, plastic, thin metal, or other flexible material, often with a buckle, that is used to fasten, secure, carry, or hold onto something.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A badge-holding device comprising:

a backing, a recessed channel, a badge retainer, a black band, one or more chain loops, a plurality of card pockets, and a clip;

wherein the badge-holding device stores and displays a badge;

wherein the badge-holding device stores one or more cards and currency;

wherein the backing is a rigid base onto which the badge retainer, the black band, the plurality of card pockets, and the clip are coupled;

wherein the backing is fabricated from a single material or the backing is fabricated from a rigid core material enclosed by a covering;

wherein the recessed channel is a vertical depression on a front face of the backing;

wherein the recessed channel provides space for a pin of the badge to seat into so that the back of the badge rests flush on the front face of the backing;

wherein the badge retainer is a surface that the badge is pinned onto;

wherein the badge retainer is a mesh or perforated material which accommodates inconsistent sizes for the badges;

wherein the badge retainer covers at least the recessed channel of the front face;

wherein the badge retainer covers a portion of the front face larger than the recessed channel, up to and including the entire surface of the front face.

2. The badge-holding device according to claim 1 wherein the black band is a strap of black, elastic material;

wherein one end of the black band couples to the side of the backing at a midpoint of the side such that the black band is pulled across the front face of the backing, crossing perpendicular to the recessed channel;

wherein the black band is pulled across the front of the badge as an honor band during times when mourning band protocol is in effect;

wherein when the black band is not being used, the black band is tucked into one of the plurality of card pockets on the rear side of the backing.

3. The badge-holding device according to claim 2 wherein the black band comprises a band fastener to hold the black band in place while it is being displayed.

4. The badge-holding device according to claim 2 wherein when the black band is not being displayed, it is tucked into one of the plurality of card pockets.

5. The badge-holding device according to claim 4 wherein the badge-holding device is adapted to be worn around a neck of a user by passing a chain through the one or more chain loops.

6. The badge-holding device according to claim 5 wherein the one or more chain loops are coupled to the top of the backing.

7. The badge-holding device according to claim 6 wherein the one or more chain loops are oriented so that the openings of each of the one or more chain loops align with each other if the one or more chain loops comprise more than one loop.

8. The badge-holding device according to claim 7 wherein the plurality of card pockets are used to hold the one or more cards.

9. The badge-holding device according to claim 8 wherein each of the plurality of card pockets is a flexible or semi-rigid flap coupled to the backing or to the plurality of card pockets that underlie it.

10. The badge-holding device according to claim 9 wherein the flap is coupled along three sides, leaving one side open for access to the space behind the flap.

11. The badge-holding device according to claim 10 wherein the plurality of card pockets are oriented with the open side at the top, on one side, or a combination thereof.

12. The badge-holding device according to claim 11 wherein one of the plurality of card pockets opens adjacent to the black band so that the black band is stored within the plurality of card pockets.

13. The badge-holding device according to claim 12 wherein the clip is a U-shaped metal spring;

wherein the clip is used to attach the badge-holding device to a belt, a garment pocket, or other article of clothing;

wherein the clip is alternatively used as a money clip if the badge-holding device is carried in the garment pocket.

14. The badge-holding device according to claim 13 wherein a first side of the clip is coupled to the plurality of card pockets on the rear side of the badge-holding device such that the U is inverted, with the open end of the U on the bottom.

15. The badge-holding device according to claim 14 wherein a second side of the clip is concave when viewed from the clip side;

wherein the end of the clip is beveled to facilitate insertion of objects into the clip.

* * * * *